US010316609B2

(12) United States Patent
Conrad et al.

(10) Patent No.: US 10,316,609 B2
(45) Date of Patent: Jun. 11, 2019

(54) BALL LAUNCHER WITH PILOT BALL

(71) Applicant: Cameron International Corporation, Houston, TX (US)

(72) Inventors: Gregory A. Conrad, Calgary (CA); Dwayne C. Raynard, Calgary (CA); Scott Smith-Napier, Calgary (CA)

( * ) Notice: Subject to any disclaimer, the term of this patent is extended or adjusted under 35 U.S.C. 154(b) by 874 days.

(21) Appl. No.: 14/699,272

(22) Filed: Apr. 29, 2015

(65) Prior Publication Data

US 2016/0319625 A1 Nov. 3, 2016

(51) Int. Cl.
*E21B 33/068* (2006.01)
*E21B 34/14* (2006.01)

(52) U.S. Cl.
CPC ..... *E21B 33/068* (2013.01); *E21B 34/14* (2013.01)

(58) Field of Classification Search
CPC ..... E21B 33/068; E21B 34/14
See application file for complete search history.

(56) References Cited

U.S. PATENT DOCUMENTS 3,263,752 A * 8/1966 Conrad ..... E21B 34/14 166/154
3,338,311 A * 8/1967 Conrad ..... E21B 34/14 166/154
3,403,729 A * 10/1968 Hickey ..... E21B 33/068 15/104.062
4,577,614 A * 3/1986 Schoeffler ..... E21B 21/106 175/218
5,277,248 A * 1/1994 Breland ..... B08B 9/055 137/268
6,390,200 B1 * 5/2002 Allamon ..... E21B 21/10 166/153
6,467,546 B2 * 10/2002 Allamon ..... E21B 21/10 166/194
7,571,773 B1 * 8/2009 West ..... E21B 23/04 137/268
7,735,548 B2 6/2010 Cherewyk
8,136,585 B2 * 3/2012 Cherewyk ..... E21B 33/068 137/268
8,167,047 B2 * 5/2012 Themig ..... E21B 34/063 166/191
8,256,515 B2 * 9/2012 Barbee ..... E21B 33/05 166/177.4
8,561,684 B2 * 10/2013 Winzer ..... E21B 33/068 166/75.15
8,631,870 B2 * 1/2014 Johnson ..... E21B 33/068 166/302
8,839,867 B2 * 9/2014 Conrad ..... E21B 43/26 166/177.5

(Continued)

*Primary Examiner* — Matthew R Buck
*Assistant Examiner* — Aaron L Lembo
(74) *Attorney, Agent, or Firm* — Eubanks PLLC

(57) ABSTRACT

An apparatus for introducing a drop ball into a well is provided. In one embodiment, the apparatus includes a wellhead assembly mounted over a well and a ball launcher for routing a drop ball into the wellhead assembly. The ball launcher includes a fluid conduit coupled to the wellhead assembly and a pilot ball disposed in the fluid conduit. The ball launcher also includes a stop positioned in the fluid conduit to prevent movement of the pilot ball past the stop while allowing movement of the drop ball past the stop and into the wellhead assembly. Additional systems, devices, and methods are also disclosed.

18 Claims, 6 Drawing Sheets

(56) References Cited

U.S. PATENT DOCUMENTS 9,010,447 B2 * 4/2015 Themig ..... E21B 34/14 166/318
9,109,422 B2 * 8/2015 Ferguson ..... E21B 33/068
9,222,345 B2 * 12/2015 Conrad ..... E21B 43/26
9,255,469 B2 * 2/2016 Conrad ..... E21B 43/26
9,260,935 B2 * 2/2016 Murphree ..... E21B 34/14
9,316,084 B2 * 4/2016 Carter ..... E21B 33/128
9,464,501 B2 * 10/2016 Kristoffer ..... E21B 33/124
9,611,721 B2 * 4/2017 Snider ..... E21B 34/12
9,617,826 B2 * 4/2017 Roessler ..... E21B 34/14
9,644,453 B2 * 5/2017 Okura ..... B29C 45/14073
9,689,232 B2 * 6/2017 Hardesty ..... E21B 34/14
2007/0227722 A1 10/2007 Atencio
2011/0048734 A1 * 3/2011 Johnson ..... E21B 33/068 166/377
2012/0125631 A1 * 5/2012 Entchev ..... E21B 33/12 166/376
2012/0152525 A1 * 6/2012 McGuire ..... E21B 33/068 166/193
2012/0211219 A1 8/2012 McGuire et al.
2012/0305270 A1 * 12/2012 Winzer ..... E21B 33/05 166/382
2013/0175038 A1 * 7/2013 Conrad ..... E21B 43/26 166/308.1
2013/0228326 A1 9/2013 Griffith et al.
2014/0262302 A1 * 9/2014 Ferguson ..... E21B 33/068 166/318
2014/0352968 A1 12/2014 Pitcher et al.
2015/0000901 A1 1/2015 Guidry et al.
2015/0007997 A1 * 1/2015 Conrad ..... E21B 43/26 166/308.1
2015/0007998 A1 * 1/2015 Conrad ..... E21B 43/26 166/308.1
2016/0146962 A1 * 5/2016 Hayward ..... E21B 43/26 166/250.1
2016/0298431 A1 * 10/2016 Conrad ..... E21B 43/26
2016/0356112 A1 * 12/2016 Artherholt ..... E21B 33/05
2017/0058641 A1 * 3/2017 Hardesty ..... E21B 43/14
2017/0089166 A1 * 3/2017 Sullivan ..... E21B 33/12

* cited by examiner

BALL LAUNCHER WITH PILOT BALL

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly through which the resource is accessed or extracted. These wellhead assemblies may include a wide variety of components, such as casing heads, tubing heads, valves, and other connected components, that facilitate drilling or extraction operations.

In some instances, balls (e.g., frac balls used for fracturing operations) are used in wells to actuate downhole components, to seal the wells, or to carry out other functions. These balls are often pumped down wells with pressurized fluids (e.g., fracturing fluid) to perform their intended functions. Pressure at the wellhead can then be lowered so that pressurized fluid in the wellbore returns the balls to the surface.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to systems for introducing balls into wells. Such systems can include a ball launcher coupled to a wellhead assembly, and balls can be loaded into the ball launcher and then introduced into a well through the wellhead assembly. In certain embodiments, the ball launcher includes a fluid conduit that extends laterally away from a wellhead assembly and a pilot ball positioned in the fluid conduit. A drop ball smaller than the pilot ball can be inserted into the fluid conduit at a location between the wellhead assembly and the pilot ball. Pressurized fluid can then be routed into the fluid conduit to push the pilot ball toward the wellhead assembly, causing the pilot ball to drive the smaller drop ball toward the wellhead assembly as well. A stop or other obstruction along the travel path of the drop ball prevents the pilot ball from falling into a central bore of the wellhead assembly, while allowing forward momentum of the smaller drop ball to carry it into the central bore of the wellhead assembly. The pilot ball can then be returned away from the stop through the fluid conduit to prepare for launch of an additional drop ball. Further, in some embodiments the drop ball is inserted into the fluid conduit of the ball launcher at a lower elevation (e.g., by an operator standing at ground level) than the point at which the drop ball is routed into the wellhead assembly.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of the some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
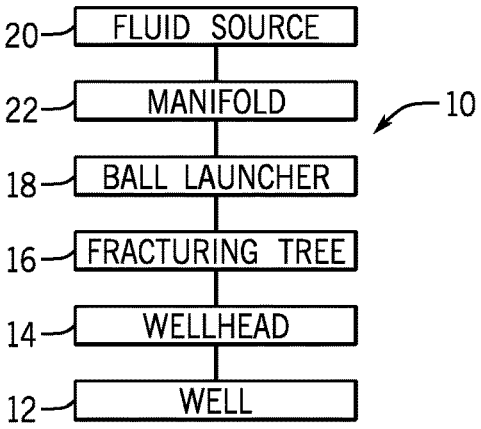
FIG. 1 is a block diagram representing an apparatus including a ball launcher connected to a wellhead assembly in accordance with an embodiment of the present disclosure.

Turning now to the present figures, a well system 10 is generally depicted in FIG. 1 in accordance with one embodiment. Notably, the system 10 facilitates production of a resource, such as oil or natural gas, from a well 12. As depicted, the system 10 includes a wellhead assembly having a wellhead 14 installed at the well 12. The wellhead 14 can include various components, such as one or more casing heads or tubing heads installed above various casing or tubing in the well 12. In certain embodiments, the well 12 is a surface well accessed through equipment of wellhead 14 installed at surface level (e.g., on the ground). But the well 12 could take other forms, such as an offshore platform well.

The wellhead assembly also includes a fracturing tree 16 coupled to the wellhead 14 for fracturing the well 12 and enhancing production. By way of example, resources such as oil and natural gas are generally extracted from fissures or other cavities formed in various subterranean formations. The well 12 can penetrate a resource-bearing formation and be subjected to a fracturing process that creates man-made fractures in the formation. This facilitates coupling of pre-existing fissures and cavities, allowing fluids in the formation to flow into the well 12. For instance, in hydraulic fracturing, a fracturing fluid (e.g., a slurry including sand and water) can be pumped into the well 12 through the fracturing tree 16 and the wellhead 14 to increase the pressure inside the well 12 and form the man-made fractures noted above. Such fracturing often increases both the rate of production from the well and its total production.

The system 10 also includes a ball launcher 18 for introducing balls into the well 12. In some embodiments, the ball launcher 18 can be used to drop frac balls into the well 12, as described below with respect to FIG. 2. But it is noted that the ball launcher 18 could also be used to drop other balls into a well, such as balls that actuate downhole tools or other components, or balls that seal a portion of the well for purposes other than fracturing. The system 10 further includes a fluid source 20 coupled to the ball launcher 18. In at least some embodiments, such as that depicted in FIG. 1, the fluid source 20 is coupled to the ball launcher 18 by a manifold 22. The manifold 22 can be used to connect the fluid source 20 to ball launchers 18 for multiple wellhead assemblies. But in other embodiments, the fluid source 20 can be coupled directly to a single ball launcher 18 without a manifold 22. As described in greater detail below, fluid from the source 20 can be routed into a conduit of the ball launcher 18 to facilitate injection of a ball into the well 12 through the wellhead 14.

Figure 2:
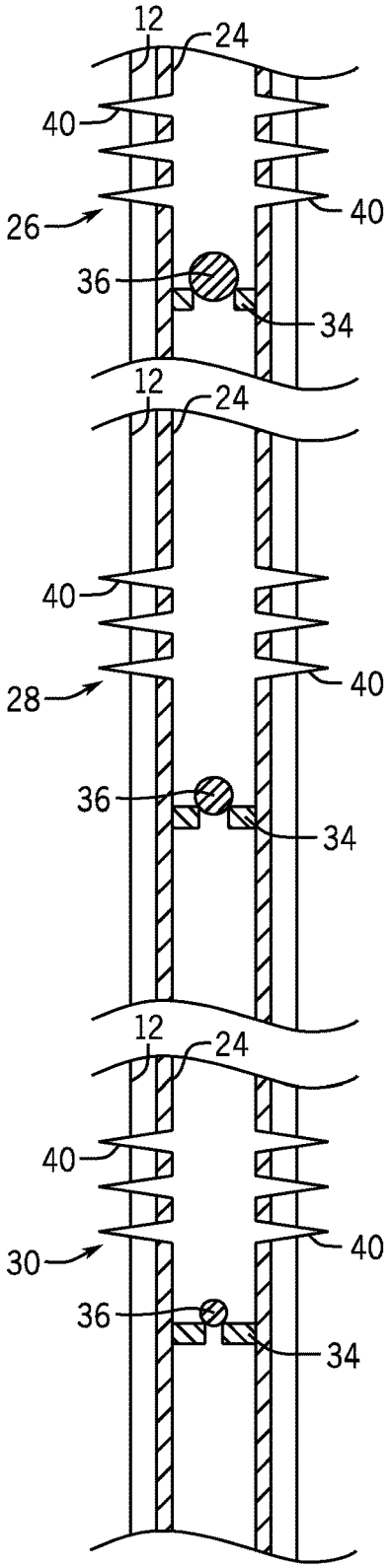
FIG. 2 schematically depicts the use of balls dropped into a well to seal portions of the well in accordance with one embodiment.

One example of the use of balls in the well 12 for fracturing is generally illustrated in FIG. 2. In this embodiment, the well 12 includes a casing 24. The well 12 is depicted as having zones or sections 26, 28, and 30. Each of these sections of the well 12 can be isolated from another portion further downhole in the well through the use of frac balls introduced into the well. As presently shown, the casing 24 includes baffles or packers 34 with openings for allowing fluid flow and for receiving balls 36. Although three balls 36 (with three corresponding packers 34) are shown in FIG. 2 for explanatory purposes, it will be appreciated that the well 12 can include any number of desired zones that can be isolated with respective sets of packers 34 and balls 36. Further, the packers 34 may be provided as part of sliding sleeve assemblies in which the balls 36 can be seated on the packers 34 such that pressure on the balls 36 cause sliding sleeves to move to expose ports in the casing 24. In this manner, the balls 36 can be used to selectively open the sleeves to facilitate access to a formation through the ports (e.g., to enable fracturing of the formation via the ports).

In the depicted embodiment, the packers 34 are designed to receive balls 36 of different sizes. More specifically, the packer 34 furthest from the surface in the well 12 has the smallest opening and receives the smallest ball 36. Moving up the well 12 from that packer 34, additional packers 34 have openings to receive balls 36 of increasing size. That is, the closer the packer 34 is to the surface, the larger the ball 36 it is intended to receive.

By way of example, during a fracturing operation, the smallest ball 36 can be introduced into the well (e.g., along with fracturing fluid) and that ball 36 can pass through openings of diminishing size in the other packers 34 until it reaches the packer 34 furthest from the surface (corresponding to zone 30 in FIG. 2). Fracturing fluid can be pumped through ports 40 in the casing 24 in zone 30 to fracture the surrounding formation. The ports 40 may be formed in any suitable manner. For example, the ports 40 can be formed in the casing 24 before installation, or they can be formed by perforating the casing 24 after it is installed in the well 12. The next ball 36 can then be introduced (e.g., to engage the next packer 34 that isolates zone 28 from zone 30) and fracturing of zone 28 may also be performed.

The process of dropping a ball 36 to engage a packer and fracturing the zone above the packer (e.g., through ports 40) can be repeated with frac balls of increasing size (that is, from smallest to largest). In at least some embodiments, all of the balls 36 can be returned to the surface together (e.g., by wellbore pressure) after fracturing of the well 12 is completed. But in other embodiments, each ball 36 can be returned after fracturing a respective zone of the well 12, or groups of balls 36 can be returned together after fracturing multiple zones. In other instances, the balls 36 could be left in the well 12 (e.g., to be drilled out later or, for balls of certain materials, to dissolve on their own).

Figure 3:
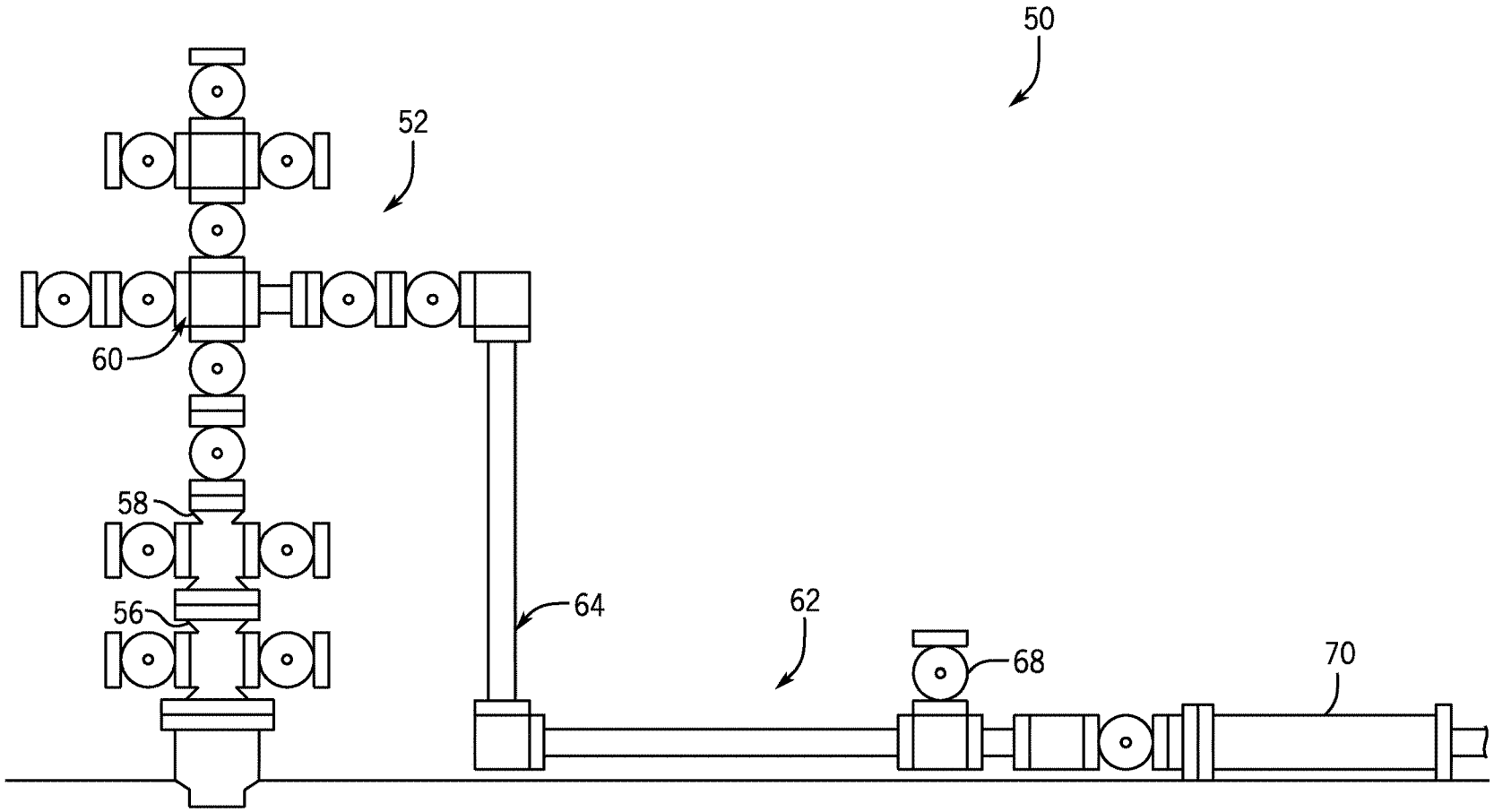
FIG. 3 is an elevational view of a ball launcher coupled to a wellhead assembly, the ball launcher including a fluid conduit for routing drop balls into the wellhead assembly, in accordance with one embodiment.

An example of an apparatus 50 including a wellhead assembly 52 and a ball injection assembly 62 for introducing balls into a well through the wellhead assembly 52 is generally shown in FIG. 3. The wellhead assembly 52 is positioned over the well 12 and includes a casing head 56, a tubing head 58, and a fracturing tree 60. The ball injection assembly 62 (also referred to herein as ball launcher 62) includes a fluid conduit 64 coupled to, and extending laterally away from, the wellhead assembly 52. The conduit 64 is in fluid communication with a central bore of the wellhead assembly 52, and can include any suitable, hollow components that allow a ball to be conveyed through the conduit 64 into the wellhead assembly. In the embodiment shown in FIG. 3, the fluid conduit 64 includes pipes, connection blocks, valves, and spools.

The depicted ball launcher 62 includes an entry valve 68 (e.g., a gate valve) for introducing balls into the fluid conduit 64. The entry valve 68 can be opened when the fluid conduit 64 is unpressurized to allow an operator to insert a ball into the conduit 64 via a ball injection port 72 (FIG. 4) and then closed to seal the ball within the conduit. In other embodiments, the valve 68 can be omitted and balls can be introduced into the fluid conduit 64 in some other way, such as through a ball injection port 72 with a removable cap.

Figure 4:
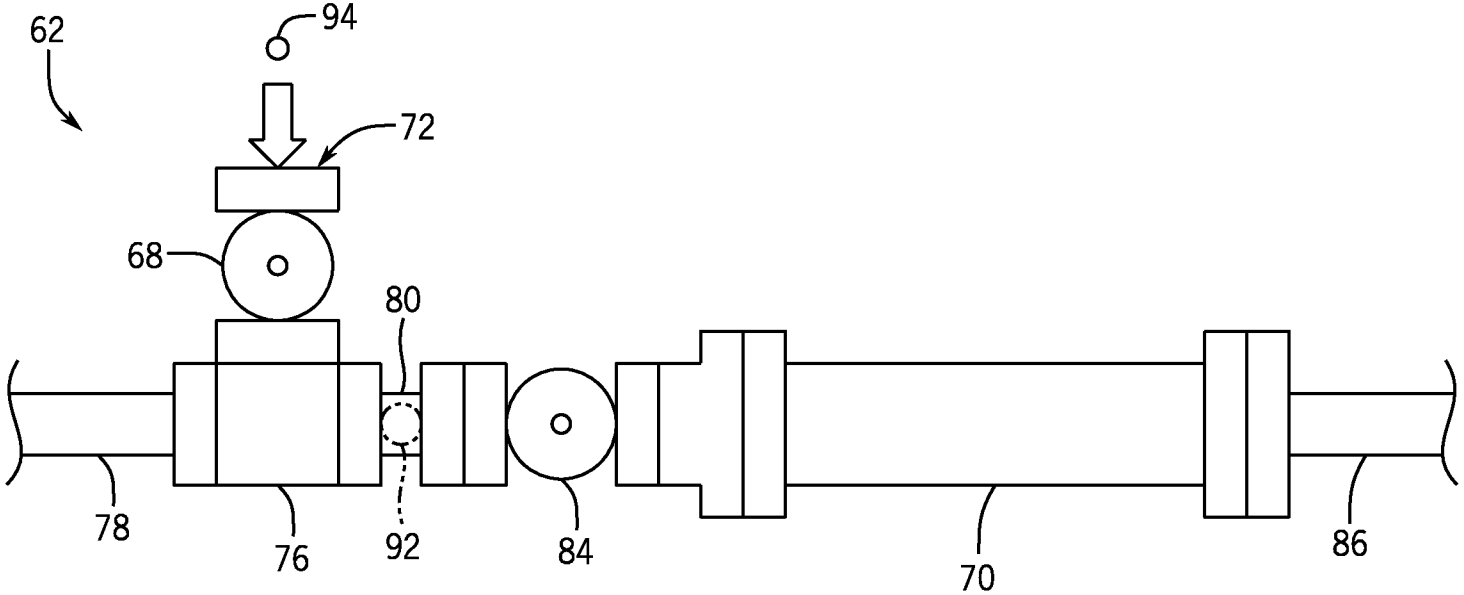
FIG. 4 generally depicts introduction of a drop ball into the fluid conduit of the ball launcher of FIG. 3 and a pilot ball for driving the drop ball through the fluid conduit toward the wellhead assembly in accordance with one embodiment.

The apparatus 50 can also include a ball catcher 70 for receiving balls returning to the surface from the well 12 during a flowback operation. The ball catcher 70 of FIG. 3 is coupled to an end of the fluid conduit 64 apart from the wellhead assembly 52, which allows returning balls to be routed through the fluid conduit 64 and into the catcher 70. As shown in FIG. 4, the fluid conduit of the ball launcher 62 includes a connection block 76 coupled to a fluid pipe 78 and to the entry valve 68. The ball catcher 70 is also coupled to the connection block 76 via a spool 80 and a valve 84 (e.g., a gate valve) of the conduit 64.

A fluid pipe 86 is connected to the ball catcher 70 for routing fluid (e.g., pumped from the fluid source 20) into the fluid conduit 64 through the ball catcher 70 to launch balls into a well. More specifically, the ball launcher 62 includes a pilot ball 92 that can be pushed through the fluid conduit 64 toward the wellhead assembly 52. In at least some embodiments, an operator inserts a ball 94 that is to be dropped into the well 12 (i.e., a drop ball) through the ball injection port 72 and the open valve 68 so that the ball 94 is positioned inside the conduit between the wellhead assembly 52 and the pilot ball 92. After closing the valve 68, pressurized fluid is routed through the pipe 86 and the ball catcher 70 to the pilot ball 92 (e.g., by opening valve 84). The pressurized fluid pushes the pilot ball 92 through the fluid conduit 64 toward the wellhead assembly 52, causing the pilot ball 92 to drive the drop ball 94 through the conduit toward the wellhead assembly.

Figure 5:
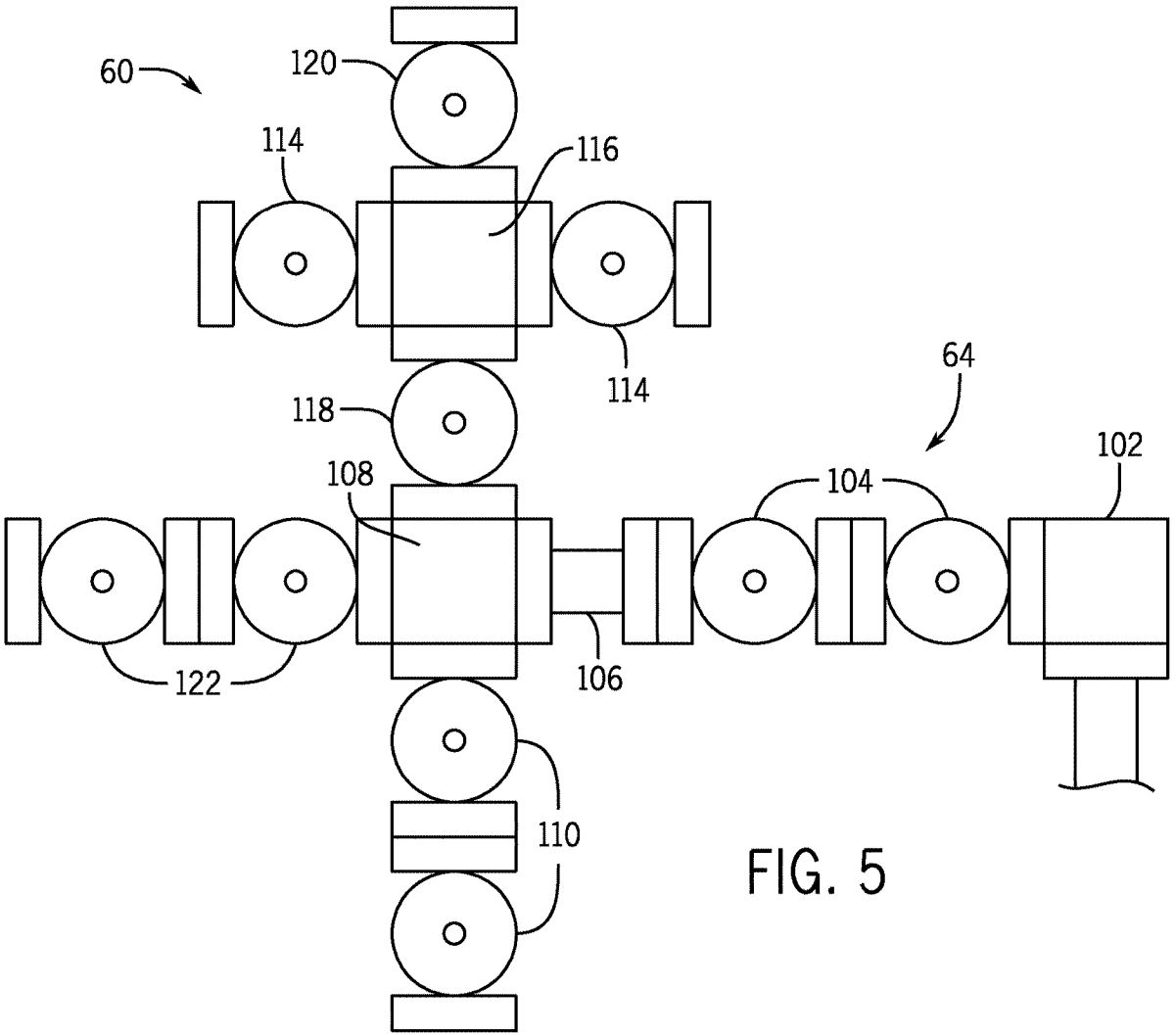
FIG. 5 depicts an end of the fluid conduit of FIG. 3 coupled to a fracturing tree of the wellhead assembly in accordance with one embodiment.

In one embodiment, the fluid conduit 64 of the ball launcher 62 is coupled to the fracturing tree 60 of the wellhead assembly 52 as shown in FIG. 5. The depicted fluid conduit 64 includes a connection block 102, wing valves 104, and an adapter spool 106 that is connected to a connection block 108 of the fracturing tree 60. Valves 104 can be opened to allow passage of drop balls 94 and closed to isolate the majority of the fluid conduit 64 from fluid in the central bore through the fracturing tree 60 (e.g., during fracturing).

The fracturing tree 60 can have any suitable configuration, but in FIG. 5 is shown to include master valves 110 that can be selectively opened to allow passage of fluid or items (e.g., fracturing fluid or drop balls 94) through lower components of the wellhead assembly 52 and into the well 12. Fracturing fluid can be pumped into the fracturing tree 60 through valves 114 coupled to connection block 116. The fracturing tree 60 also includes valves 118 and 120 along its central axis. Valve 118 can be closed to isolate the connection block 116 from the connection block 108, and valve 120 can be opened to access the bore of the tree 60. Further, a kill line can be coupled to the fracturing tree 60 via valves 122. The various valves depicted in FIG. 5 can be provided as gate valves or in some other form. Further, the various valves could be operated in any suitable manner, such as manually or hydraulically.

In at least some embodiments, including that depicted in FIGS. 3-5, the ball launcher is configured so that a ball to be launched into the well 12 is inserted into the fluid conduit 64 at a lower elevation than that at which the ball enters the wellhead assembly 52. For instance, as generally shown in FIG. 3, a portion of the fluid conduit 64 runs along the ground at an elevation that allows an operator standing on the ground to manually insert a ball into the conduit 64 via the ball injection port 72. This ground-based portion of the fluid conduit 64 and the ball injection port 72 can be positioned less than eight feet (approximately 2.4 meters) above the ground to facilitate insertion of balls into the fluid conduit 64 by an operator. For convenience, the ground-based portion of the fluid conduit 64 and the ball injection port 72 could be positioned even lower in some embodiments, such as less than six feet (approximately 1.8 meters) above the ground. A ball inserted into the fluid conduit 64 can then be driven through the conduit 64 to enter the wellhead assembly 52 at a higher elevation. In contrast to tree-mounted ball launching systems positioned vertically above a wellhead, the position of the ball injection port 72 at ground level remote from the wellhead assembly in some embodiments allows an operator to insert balls into the ball launcher 62 at an appropriate distance from the high-pressure area of the wellhead and at a lower elevation that does not require the operator to climb scaffolding or ladders. Although the fluid conduit 64 is depicted in FIG. 3 as having two horizontal portions (one at the wellhead assembly, the other located at ground level apart from the wellhead assembly) joined by a vertical portion, the fluid conduit 64 could take other forms. For example, the fluid conduit 64 could have an inclined pipe that causes the driven ball to move upward while moving laterally closer to the wellhead assembly.

As noted above, the pilot ball 92 can be used to drive the drop ball 94 through the fluid conduit 64 and into the wellhead assembly 52. The apparatus 50 includes a stop or some other obstruction along the travel path of the drop ball 94. This obstruction prevents the pilot ball 92 from falling from the fluid conduit 64 into the central bore of the wellhead assembly 52, while still allowing drop balls 94 to be routed through the fluid conduit 64, past the obstruction, and into the bore of the wellhead assembly 52.

Figure 6:
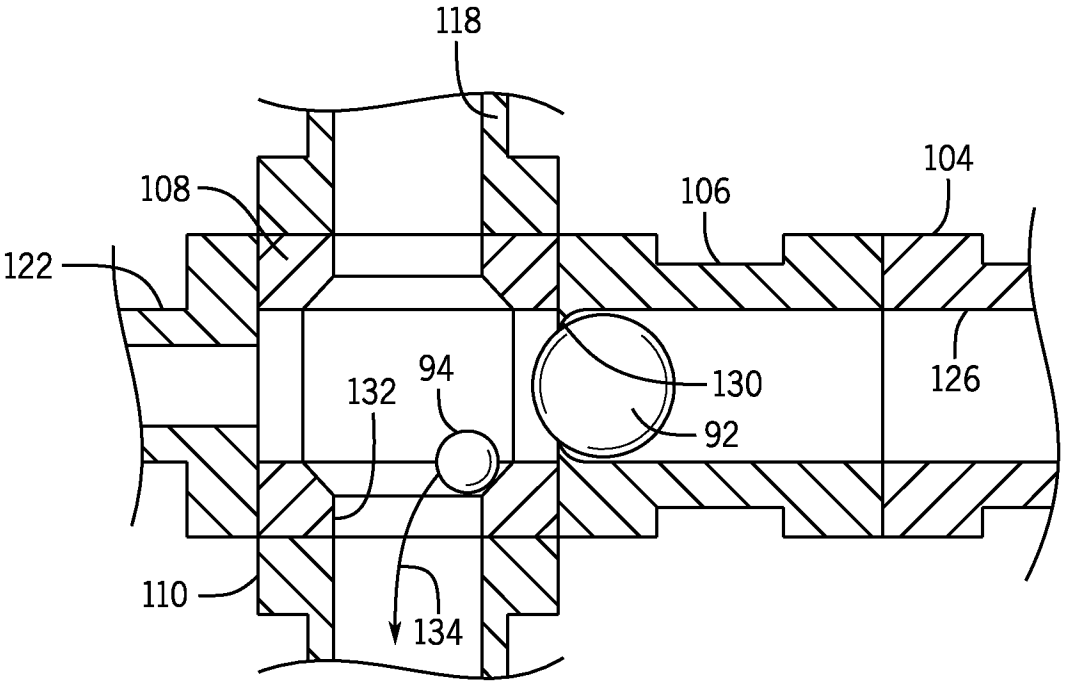
FIG. 6 is a cross-section of a portion of the apparatus depicted in FIG. 5 and shows an obstruction in the fluid conduit that stops movement of the pilot ball of FIG. 3 while allowing a drop ball to pass and enter into a central bore of the wellhead assembly.

One example of such an obstruction is depicted in FIG. 6 as a stop shoulder 130 at an end of a bore 126 of the fluid conduit 64. In a ball launch operation, the fluid conduit 64 is pressurized behind the pilot ball 92 to drive the pilot ball 92 and the drop ball 94 through the bore 126 toward the wellhead assembly 52 (e.g., to the fracturing tree 60). While drop balls 94 are smaller than the pilot ball 92 and can freely pass the stop shoulder 130 to enter a central bore 132 of the wellhead assembly 52, the stop shoulder 130 prevents passage of the larger pilot ball 92 and retains it within the bore 126 of the fluid conduit 64. In response to pressure, the pilot ball 92 drives the drop ball 94 toward the central bore 132 until the pilot ball 92 reaches the stop shoulder 130. The stop shoulder 130 prevents further movement of the pilot ball 92 toward the central bore 132, but the forward momentum of the drop ball 94 carries it into the central bore 132 so that the ball 94 can fall down the bore 132 (as generally indicated by arrow 134) and into the well 12.

In at least some embodiments, pressure within the bore 126 can be monitored to verify launch of the drop ball 94 into the central bore 132. For example, a pressure sensor can be coupled to the fluid conduit 64 (e.g., at the adapter spool 106) to detect fluid pressure in the bore 126. When the pilot ball 92 engages the stop shoulder 130 as shown in FIG. 6, pressure in the bore 126 behind the pilot ball 92 will increase. The position of the pilot ball 92 against the stop shoulder 130 can be determined from this pressure increase. And with the stop shoulder 130 positioned near the central bore 132, the detected position of the pilot ball 92 against the shoulder 130 is indicative of passage of the drop ball 94 past the shoulder 130 and into the central bore 132.

The stop shoulder 130 is shown in FIG. 6 as positioned at an end of the adapter spool 106, but the shoulder 130 could be provided elsewhere in the bore 126 or in the wellhead assembly itself (e.g., at the port of the connecting block 108 to which the fluid conduit 64 is coupled). Further, although the shoulder 130 is provided as one example of an obstruction for preventing the pilot ball 92 from falling down the central bore 132, other obstructions could also or instead be used. For instance, the interior of the adapter spool 106 could have a conical profile with an inner diameter at some portion of the spool smaller than the diameter of the pilot ball 92, or the port of the connection block 108 to which the fluid conduit 64 is coupled could have a smaller diameter than that of the pilot ball 92.

After the drop ball 94 is pushed into the central bore 132, the pilot ball 92 can be returned through the fluid conduit 64 past the ball injection port 72 (e.g., to the position shown in FIG. 4). In some instances, a fracturing operation is performed after the drop ball 94 is dropped into the well 12 and fracturing fluid pressure in the bore 132 pushes the pilot ball 92 through the conduit 64 away from the wellhead assembly 52. Once the pilot ball 92 is positioned remote from the wellhead assembly 52 beyond the ball injection port 72, another drop ball 94 can be inserted into the fluid conduit 64 for launch into the well. Further, the process described above can be repeated for launching additional drop balls 94 into the well 12. For instance, dozens of drop balls 94 can be individually loaded into the fluid conduit 64 and driven by the pilot ball 92 for introduction to the well 12. In one embodiment, the dozens of drop balls 94 are loaded into the conduit 64 and launched into the well 12 in sequence from smallest to largest (e.g., with diameters of the balls 94 increasing by one-eighth-inch (approximately 3.2 mm) intervals). Additionally, an operator can individually verify the size of each of the drop balls 94 before loading the ball 94 into the fluid conduit 64 for launch into the well 12.

Figure 7:
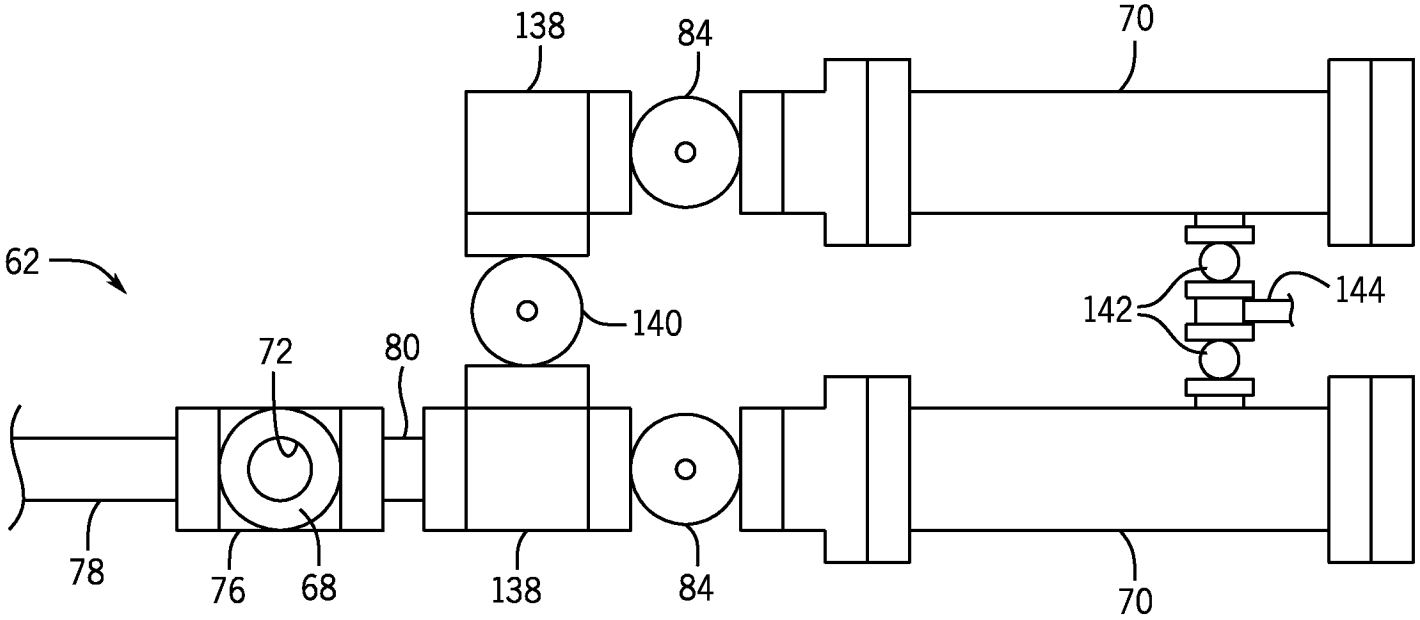
FIG. 7 depicts a pair of ball catchers for receiving, through a fluid conduit of a ball launcher, drop balls returning from a well in accordance with one embodiment.

In at least some embodiments, multiple ball catchers 70 are coupled to the ball launcher 62 for receiving the drop balls 94 returned to the surface. As shown by way of example in FIG. 7, two ball catchers 70 are coupled, in parallel, to the ball launcher 62 via connection blocks 138 and valves 84. A valve 140 between the connection blocks 138 allows an operator to control travel of the returning balls 94 into the catchers 70. If one of the ball catchers 70 becomes clogged (e.g., from the balls, sand, and debris in the flowback fluid), the valves 84 and 140 could be operated to route the returning fluid through the other ball catcher 70 while isolating the clogged ball catcher 70. The depicted apparatus also includes a manifold 144 having valves 142 that can be used to control fluid flow through the catchers 70. Pressurized fluid can be supplied through the manifold 144 to the fluid conduit 64 (via either or both of the ball catchers 70) for pushing the pilot ball 92 and launching drop balls 94 into the well 12. The manifold 144 could also or instead be used during a flowback process to route returning fluid from the catchers 70.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a wellhead assembly mounted over a well;

a ball launcher for routing a drop ball into the wellhead assembly, the ball launcher including:

a fluid conduit coupled to the wellhead assembly;

a pilot ball disposed in the fluid conduit; and a stop positioned in the fluid conduit to prevent movement of the pilot ball past the stop within the fluid conduit while allowing movement of the drop ball past the stop and into the wellhead assembly;

wherein at least a portion of the fluid conduit is at a lower elevation than that of an end of the fluid conduit that is connected at the wellhead assembly;

wherein the stop is located at the end of the fluid conduit connected to the wellhead assembly.

2. The apparatus of claim 1, wherein the fluid conduit includes a spool having the stop.

3. The apparatus of claim 2, wherein the spool having the stop is attached to the wellhead assembly.

4. The apparatus of claim 3, wherein the spool having the stop is attached to the wellhead assembly at a higher elevation than that of a ball injection port for inserting the drop ball into the fluid conduit.

5. The apparatus of claim 3, wherein one end of the spool having the stop is attached to the wellhead assembly and an opposite end of the spool having the stop is attached to a valve of the fluid conduit.

6. The apparatus of claim 1, comprising a ball catcher coupled to the ball launcher.

7. The apparatus of claim 6, wherein the ball catcher is attached to a valve of the fluid conduit of the ball launcher.

8. The apparatus of claim 7, comprising:

an additional ball catcher coupled to the fluid conduit of the ball launcher; and a manifold coupled to the ball catcher and the additional ball catcher.

9. The apparatus of claim 1, wherein the portion of the fluid conduit that is at the lower elevation includes a ball injection port for inserting the drop ball into the fluid conduit, and the ball injection port is less than eight feet above ground level.

10. The apparatus of claim 1, wherein the wellhead assembly includes a fracturing tree.

11. An apparatus comprising:

a wellhead assembly having a central bore;

a ball injection assembly including a fluid conduit coupled to and extending away from the wellhead assembly, the fluid conduit in fluid communication with the central bore of the wellhead assembly such that a drop ball can be routed along a travel path through the fluid conduit and the wellhead assembly into the central bore of the wellhead assembly; and an obstruction along the travel path, wherein the ball injection assembly includes the obstruction at an end of the fluid conduit connected at the wellhead assembly or the wellhead assembly includes the obstruction, and the obstruction is configured to permit the drop ball to pass the obstruction while preventing a pilot ball larger than the drop ball from passing the obstruction.

12. The apparatus of claim 11, wherein the wellhead assembly includes a fracturing tree and the fluid conduit of the ball injection assembly is coupled to and extends away from the fracturing tree.

13. The apparatus of claim 11, wherein the obstruction is a shoulder in the fluid conduit.

14. The apparatus of claim 11, comprising the drop ball or the pilot ball.

15. A method comprising:

inserting a first ball into a conduit of a ball launcher;

pumping fluid into the ball launcher so as to push a second ball in the conduit of the ball launcher against the first ball and to cause the first ball to be driven to a wellhead assembly by the second ball;

returning the second ball to the ball launcher;

inserting a third ball into the conduit of the ball launcher; and pumping fluid into the ball launcher to cause the second ball to drive the third ball to the wellhead assembly.

16. The method of claim 15, comprising detecting entry of the first ball into a central bore of the wellhead assembly by monitoring pressure within the ball launcher.

17. The method of claim 15, comprising flowing back the first ball and one or more additional balls from a well through the wellhead assembly and through the conduit of the ball launcher to a ball catcher.

18. The method of claim 15, comprising:

dropping the first ball into a well through the wellhead assembly; and fracturing the well.

* * * * *